US008827388B2

(12) United States Patent
Johansson et al.

(10) Patent No.: US 8,827,388 B2
(45) Date of Patent: Sep. 9, 2014

(54) DEVICE FOR SECURING A SOFT ENDING OF THE OPENING MOVEMENT OF A DRAWER

(75) Inventors: Tobias Johansson, Älmhult (SE); Tomas Karlsson, Karlshamn (SE)

(73) Assignee: Inter IKEA Systems B.V., Delft (NL)

( * ) Notice: Subject to any disclaimer, the term of this patent is extended or adjusted under 35 U.S.C. 154(b) by 927 days.

(21) Appl. No.: 12/451,372

(22) PCT Filed: May 8, 2008

(86) PCT No.: PCT/IB2008/001138

§ 371 (c)(1),
(2), (4) Date: Aug. 2, 2010

(87) PCT Pub. No.: WO2008/139298

PCT Pub. Date: Nov. 20, 2008

(65) Prior Publication Data

US 2010/0293746 A1 Nov. 25, 2010

(30) Foreign Application Priority Data

May 9, 2007 (DK) ..... PA 2007 00695

(51) Int. Cl.

| | |
|---|---|
| ***A47B 95/00*** | (2006.01) |
| ***E05F 1/16*** | (2006.01) |
| ***A47B 88/04*** | (2006.01) |

(52) U.S. Cl.

CPC ..... *E05F 1/16* (2013.01); *E05Y 2201/424* (2013.01); *A47B 2210/0094* (2013.01); *E05Y 2201/256* (2013.01); *A47B 88/0481* (2013.01); *E05Y 2201/264* (2013.01); *E05Y 2201/21* (2013.01); *E05Y 2900/20* (2013.01)

USPC ..... 312/333

(58) Field of Classification Search

USPC ..... 312/333, 334.44–334.47; 384/18; 16/85

See application file for complete search history.

(56) References Cited

U.S. PATENT DOCUMENTS

| | | | | |
|---|---|---|---|---|
| 6,932,200 | B2 * | 8/2005 | Booker et al. | 188/300 |
| 7,309,115 | B2 * | 12/2007 | Blum et al. | 312/334.13 |
| 7,845,744 | B2 * | 12/2010 | Chen et al. | 312/334.6 |
| 2004/0222723 | A1 * | 11/2004 | Fitz | 312/334.6 |
| 2004/0227280 | A1 * | 11/2004 | Booker et al. | 267/64.11 |
| 2005/0174021 | A1 * | 8/2005 | Blum et al. | 312/334.13 |
| 2006/0016279 | A1 * | 1/2006 | Sato et al. | 74/89.17 |
| 2006/0017359 | A1 * | 1/2006 | Sato et al. | 312/333 |

FOREIGN PATENT DOCUMENTS

| | | |
|---|---|---|
| DE | 19935120 | 2/2001 |
| EP | 1541057 | 6/2005 |
| WO | WO2006025149 | 3/2006 |
| WO | WO2006050510 | 5/2006 |
| WO | WO2007121731 | 11/2007 |

* cited by examiner

*Primary Examiner* — Darnell Jayne
*Assistant Examiner* — Timothy M Ayres
(74) *Attorney, Agent, or Firm* — Cooper & Dunham LLP

(57) ABSTRACT

Device for securing a soft ending of the opening movement of a drawer as the latter is drawn towards an outer limit stop (10), the drawer being mounted in a (not-shown) furniture body and capable of being pulled out from said body, and in which there may be one or more rails (1, 3) between the drawer and the furniture body. The device comprises a damper (6) filled with a fluid medium attached to the furniture body—or to a rail of the furniture body—and a piston with a piston rod (7) being reciprocable in said damper (6), the free end of the piston rod (7) being attached to a tilt-able rocker (9). Whenever the piston rod (7) close to its outermost position is moved in and out in the damper (6), the rocker can be moved on a guide portion (17)—mounted at the damper (6)—between a first end position (FIG. 2) close to the damper, in which a first pin (19) mounted at the back of the drawer may engage with the rocker (9), and a second end position (10) far from the damper (6), in which the piston rod (7) is in its outermost position. This device can work in an especially reliable way.

12 Claims, 4 Drawing Sheets

DEVICE FOR SECURING A SOFT ENDING OF THE OPENING MOVEMENT OF A DRAWER

TECHNICAL FIELD

The invention relates to a device for securing a soft ending of the opening movement of a drawer as the latter is drawn towards an outer limit stop, the drawer being mounted in a furniture body and, capable of being pulled out from said body, and in which there may be one or more rails between the drawer and the furniture body.

BACKGROUND

A spring mechanism used for the ending of the closing movement of a drawer mounted in a furniture body is known from prior art. However, the reliability of the mechanism is not sufficient when it comes to opening the'drawer.

The purpose of the invention is to indicate a device of the type mentioned above, which is particularly reliable when it comes to opening a drawer in a furniture body.

DISCLOSURE OF THE INVENTION

The device according to the invention is characterized in that it comprises a damper filled with a fluid medium, such as air, gas, oil, water or other types of liquids, attached to the furniture body—or to a rail of the furniture body—and a piston with a piston rod being reciprocable in said damper, the free end of the piston rod being attached to a tilt-able rocker, and where the rocker, whenever the piston rod is moved in and out in the damper, can be moved on a guide portion—mounted at the damper—between a first end position close to the damper, in which a first pin mounted at the back of the drawer may engage with the rocker, and a second end position far from the damper, in which the piston rod is in its outermost position. As a result, it is achieved that a user opening the drawer will realize that the drawer goes smoothly. However, as the drawer approaches the outer limit stop, the user will become aware of a gradually increasing resistance to moving the drawer. This makes the device particularly reliable whether or not the drawer is rather heavy or light.

According to the invention, a coil spring may be mounted around the piston rod on the part that lies between the damper and the rocker. Hereby it is achieved that the drawer—especially in the beginning of the opening process—will give the impression that it goes smoothly. This results from the fact hat the coil spring resists to the forces that might try to keep the drawer in its position, namely frictional forces between the drawer and the furniture body.

Furthermore, according to the invention the coil spring may be mounted within the damper between the piston and a bottom piece in the damper. Hereby it is also obtained that the movement of the drawer becomes suitably easy, when the drawer is opened.

According to the invention, the rocker may also have at least one supporting element, which is placed across the principal plane of the rocker and which preferably is constituted of at least one main pin.

In addition, according to the invention the rocker may have two main pins placed at a distance from each other of more than 1.2—possibly more than 1.3—times the width of said first pin. Hereby it is achieved that said first pin in a particularly reliable way may engage with said main pins.

Additionally, according to the invention one or two auxiliary pins are arranged at a level under the main pin of the rocker, said auxiliary pin or pins being adapted so as to slide through a longitudinal—possibly open-worked—groove in the guide portion, said groove at one end having a curved groove portion in order to provide a turning of the rocker, when at least one of the auxiliary pins of the rocker has reached the curved groove portion. Hereby it is achieved that the drawer is secured particularly efficiently in closed position, since the drawer will not be able to slide unintentionally from the furniture body, if the furniture body by mistake is placed on a rather oblique base.

Furthermore, according to the invention there may be a horizontal supporting surface for the main pin(s) on the top side of the guide portion, said supporting surface having a depression on the spot closest to the damper, and in which a main pin can slide in, when the drawer is closed. Hereby it is achieved that the drawer is secured particularly reliably, when it is in the furniture body.

In addition, according to the invention the two auxiliary pins of the rocker are placed at such a distance from each other that only one of the auxiliary pins can slide into the curved groove portion. Hereby it is achieved in a particularly simple way that the drawer is secured reliably in closed position.

According to the invention the rocker may be connected to the outer end of the piston rod by means of a supporting element, which preferably is guided in a slot in the guide portion, the supporting element for example being equipped with a thickened part, which can, keep the supporting element in place in the slot. Hereby a particularly reliable steering of the outer end of the piston rod is achieved, which results in a more reliable device.

Furthermore, according to the invention the damper, the guide portion and the rocker may be made of plastic, preferably. Acetal® or polyamide. Hereby it is achieved that the device becomes both light and strong.

Additionally, according to the invention the coil spring may be a pressure spring. Hereby it is achieved that the drawer, when it is opened, goes very smoothly. When the drawer is completely opened, the pressure spring will be entirely relaxed.

Furthermore, according to the invention, at the connection of the drawer and the furniture body there may be mounted a device for automatically securing a soft ending of the closing movement of the drawer in the furniture body, a second pin mounted on the drawer—or on its rail—during the inward movement of the drawer being capable of engaging a second tilt-able rocker that is mounted at the end of a second piston rod in a second damper, said second pin being arranged so as to function in a plane parallel to the plane in which the first pin is functioning. Hereby it is achieved that both the opening and closing procedure of the drawer are very reliable with the effect that a user would not easily lose control over the drawer during the opening and closing procedure.

Finally, according to the invention there may be mounted a second coil spring, preferably a tension spring, near the second piston rod, preferably parallel hereto. Hereby it is achieved that also the closing of the drawer can be very reliable.

BRIEF DESCRIPTION OF THE DRAWINGS

The invention is explained in detail below with reference to the drawings, in which.

DETAILED DESCRIPTION OF THE INVENTION

Figure 1:
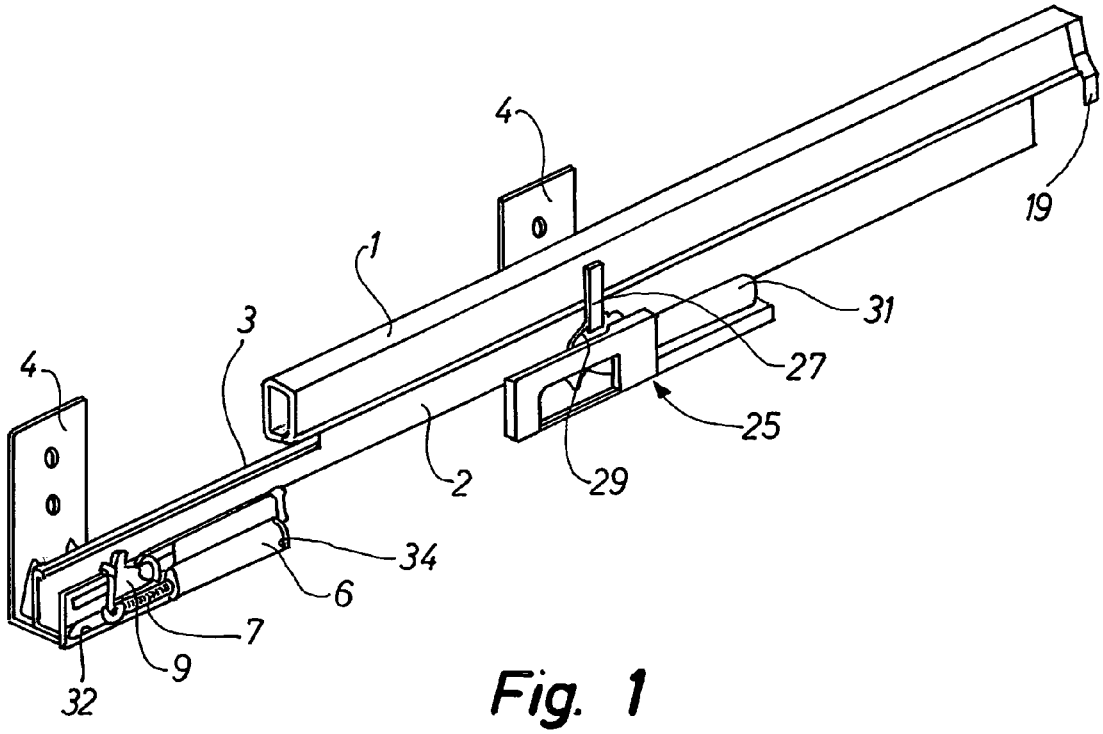
FIG. 1 is a perspective view of a first embodiment of the device according to the invention, an intermediate rail 1, which is attached to the drawer, being pushed in completely.

The device shown in FIG. 1 is, intended for the mounting of a drawer in a furniture body. Neither the drawer nor the furniture body is shown. However, the drawer is mounted right on top of the top side of a rail 1 The drawer may, when it is opened, be moved to the left as shown by arrow A in FIG. 2. The rail 1 is attached to and may be displaced in relation to a lower rail 3 that is attached to a vertical wall in the not-shown drawer hole in the not-shown furniture body.

Figure 2:
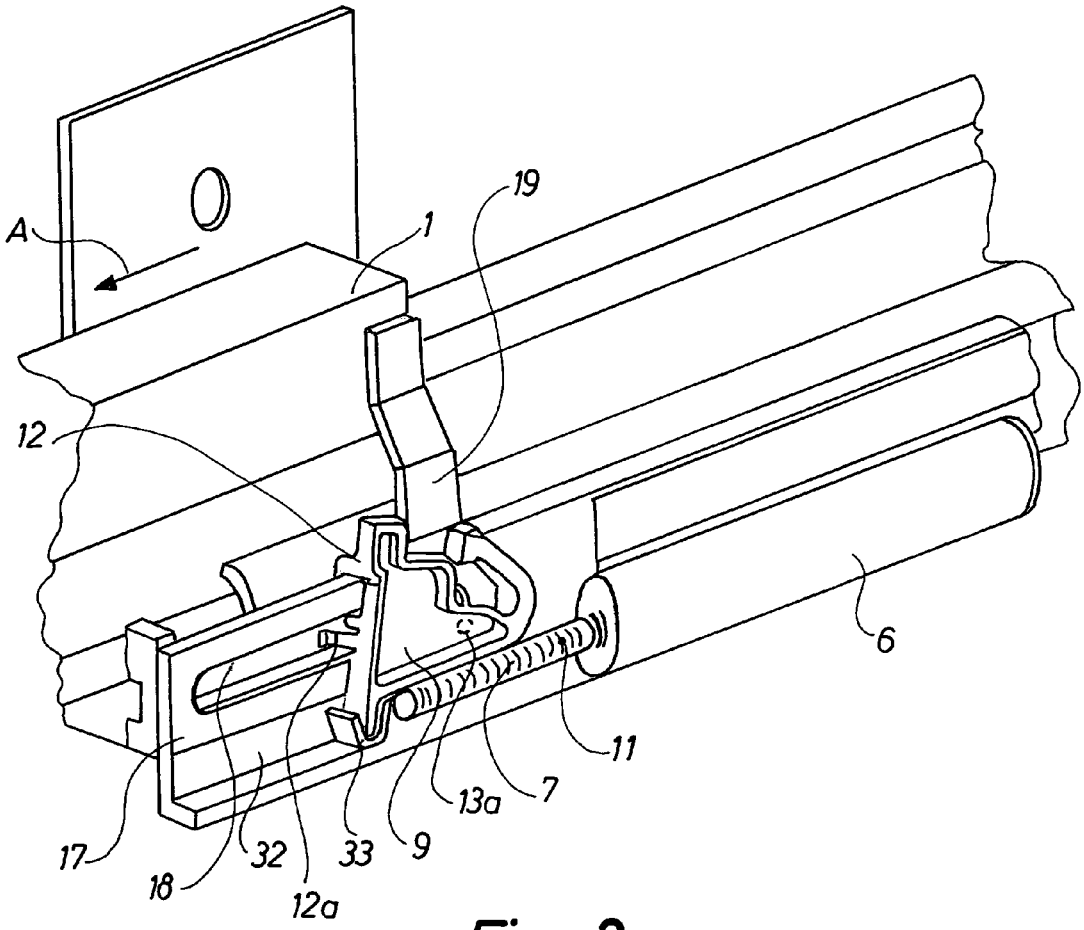
FIG. 2 same, as a rail, which is attached to the drawer, is being pulled out in the direction of arrow A, and a first pin on the rail engages the device.

FIGS. 1 and 2 show how the device at the left end of the rail 3—and thus attached to the furniture body—is furnished with a damper 6 containing a fluid medium with some degree of viscosity, for example gas, oil or water. However, the medium may also be air. In the damper 6 a not-shown piston is mounted, which is connected to a piston rod 7 as shown in FIG. 2. The not-shown piston can perform a back-and-forward movement within the damper 6. The outer free end of the piston rod 7 is connected with a rocker 9. Whenever the piston rod is moved in and out within the damper 6 as part of the movement of the piston rod (corresponding to the opening and closing movement of the drawer), the rocker 9 will be able to turn, namely when the rocker 9 is relatively close to the damper 6. FIG. 2 shows the rocker 9 in a first end position close to the damper 6. By means of a first pin 19 (mounted, at the end of the rail 1) the rocker 9 can be turned from the position shown in FIG. 2 to the position shown in FIG. 3. It should be noted that the first pin 19 and herewith the pull-out rail 1 and the corresponding drawer cannot keep on moving further to the left due to a limit stop 10 and the fact that the piston rod 7 is limited in size. It should also be noted that when the pin 19 is in the position shown in FIG. 2, it will—together with the thereto belonging rail 1 and drawer—be able to move diagonally upwards to the right in order to allow for the ending of the closing movement of the drawer as the rocker 9 in the shown position has turned free from the pin 19.

Figure 3:
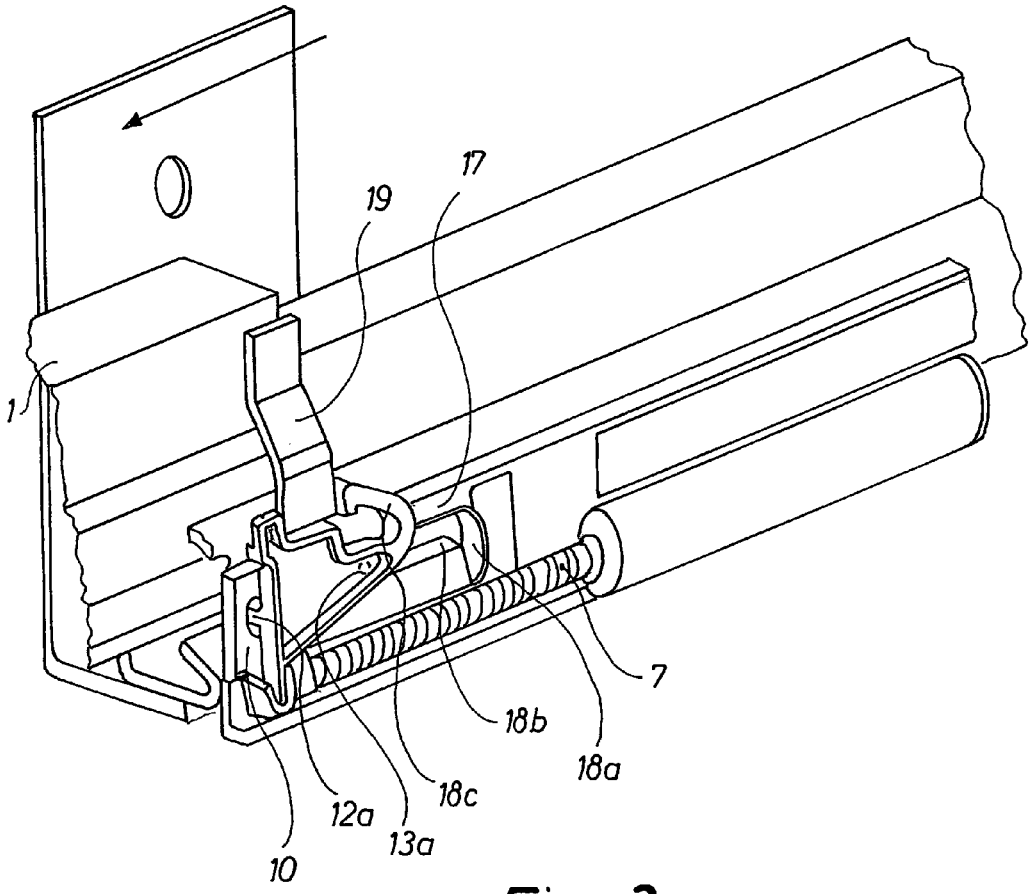
FIG. 3 same, as said first pin—and therefore the drawer—cannot be pulled out further from the furniture body.

As shown in FIGS. 2 and 3, around the piston rod 7—on the part of the piston rod 7 that lies between the damper 6 and the rocker 9—there may be mounted a coil spring 11, which can secure a not too fast pulling out of the drawer, i.e. a not too fast movement of the drawer to the left, at the final stage of the opening of the drawer (the pulling out). It should be noted that when the pin 19 of a drawer during closing has been moved into the position shown in FIG. 4, i.e. the drawer has been moved in the direction of arrow B; the pin 19 will go clear the device according to the invention, after which the drawer will be able to be pushed into its closing position in an ordinary way. The closing of the drawer is done by the user. The coil spring 11 might be mounted within the damper 6. In this case the coil spring may be arranged between the not-shown piston of the damper and the damper bottom piece 34 facing away from the piston rod.

Figure 4:
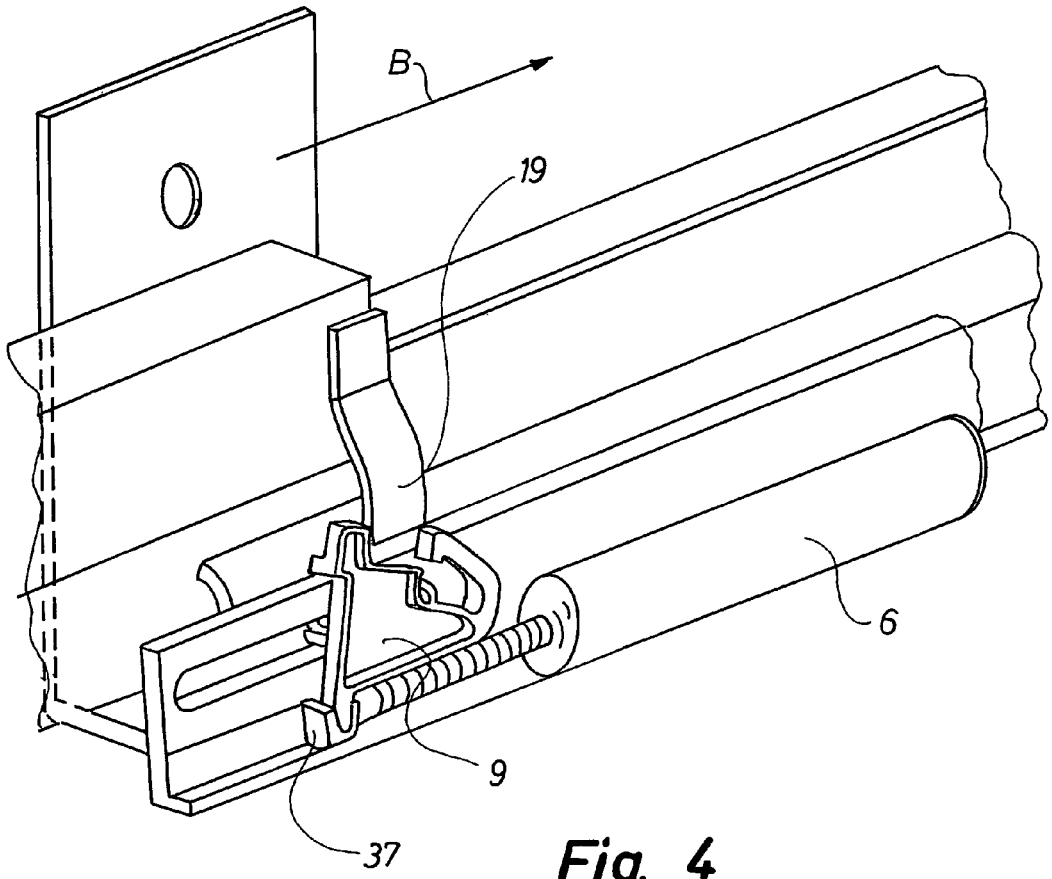
FIG. 4 the device, as the rail 1 of the drawer is being moved into the furniture body as indicated by arrow B; everything is shown in perspective.

FIG. 2 shows how the rocker 9 may have a supporting element, which is placed across the principal plane of the rocker—here in the form of two main pins 12, 13. However, the second of the two main pins is indicated by a dotted line only, since it is situated behind the rocker 9. The distance X between the main pins 12, 13 is preferably larger than 1.2—for example 1.3—times the width of the pin 19. The rocker 9 has, also two auxiliary pins 12*a*, 13*a*, which can slide through a groove 18 in the guide portion 17. As shown in FIG. 2 and FIG. 4, the second auxiliary pin 13*a* may have slid down into, the curved groove portion 18*a* in the guide portion 17. However, if the rocker 9 is turned, the auxiliary tap 13*a* can be moved upwards and rest on a wall 18*b* in a horizontal groove or slot 18 in the guide portion 17. Also the first auxiliary pin 12*a* can slide in this groove 18. It should be noted that simultaneously with the auxiliary pin 13*a* being moved downwards in the curved groove portion 18*a*, the, main pin 13 will finally slide down into a depression 35 in the guide portion 17.

The damper 6, the guide portion 17 and the rocker 9 may for example be made of plastic, preferably Acetal® or polyamide.

The coil spring 11 referred to is preferably a pressure spring.

As shown in FIG. 2 the rocker 9 may be connected to the outer end of the piston rod 7 by means of a supporting element 33, which slides in a slot 32 in the guide portion 17. As appears from FIG. 4, the supporting element 33 may have a thickened part 37, which can secure the supporting element 33 in the slot 32. As shown, the supporting element 33 may have a mainly V-shaped cross section.

As shown in FIG. 1 there might be mounted a device 25, possibly rather deep inside, the furniture body, namely on the rail 3. This device automatically secures a soft ending of the closing movement of the drawer in the not-shown furniture body. Furthermore, there may be mounted a second pin 27 on the pull-out rail 1, which, whenever the drawer is pushed inwards closing the drawer, can engage with a second tilt-able rocker 29 mounted on a second piston rod in a second damper 31. This second pin 27 is arranged so as to function in a plane parallel to the plane in which the first pin functions. The plane in which the second pin 27 functions is situated a bit further away from the reader's point of view than the plane in which the first pin 19 functions.

Close to the second piston rod, preferably parallel hereto, there may be mounted a second coil spring, which—in the same way as the first coil spring pushes the first piston rod 7 outwards—can push the second piston rod outwards. Also the second damper 31 can through a fluid medium push the second piston rod outwards.

The invention may be modified in many ways without deviating from the general idea of the invention.

The invention claimed is:

1. A device for securing a soft ending of the opening movement of a drawer as the latter is drawn towards an outer limit stop, the drawer being mounted in a furniture body, comprising:

one or more rails (1, 3) between the drawer and the furniture body, a damper (6) filled with a fluid medium and connected to the furniture body or to a rail mounted on the furniture body, a piston with a piston rod (7) being reciprocable in said damper (6), the free end of the piston rod (7) being connected to a tiltable rocker (9), the tiltable rocker being attached to the free end of the piston rod, wherein the rocker, whenever the piston rod (7) is moved relative to the damper (6), is movable along a guide portion (17) mounted at the damper between a first end position and a second end position, wherein said first end position is close to the damper, such that a first stud (19) mounted at the back of the drawer may tilt the rocker (9) when the drawer is approaching its fully opened position, and wherein the first stud is adapted to tilt the rocker and pull the free end of the piston rod in a direction away from the damper causing a dampening effect on the drawer and towards said second end position that is far from the damper (6), such that the piston rod (7) is in its outermost position and the tilting of the rocker is arrested.

2. The device according to claim 1, wherein the rocker (9) has a supporting element, wherein said supporting element is disposed across a principal plane of the rocker (9) and comprises a main pin (12).

3. The device according to claim 2, further comprising a horizontal supporting surface for the main pin (12) on a top side of the guide portion (17), said supporting surface having a depression on a spot closest to the damper (6), and in which the main pin can slide when the drawer is closed.

4. The device according to claim 1, characterized in that the rocker (9) has two main pins (12, 13) placed at a distance from each other of more than 1.3 times the width of said first stud (19).

5. The device according to claim 1, wherein one or two auxiliary pins (12*a*, 13*a*) are arranged at a level under the main pin (12, 13) of the rocker (9), said auxiliary pin or pins being adapted to slide through a longitudinal groove (18) in the guide portion (17), said groove (18) having a curved groove portion (18*a*) at one end in order to facilitate turning of the rocker (9).

6. The device according to claim 1, further comprising two auxiliary pins (12*a*, 13*a*).

7. The device according to claim 1, wherein the rocker (9) is connected to the outer end of the piston rod by means of a supporting element (33) guided in a slot (32) in the guide portion (17), the supporting element (33) comprising with a thickened part (37) for keeping the supporting element in the slot (32).

8. The device according to claim 1, wherein the damper (6), the guide portion (17) and the rocker (9) are made of plastic.

9. The device according to claim 1, further including a coil spring (11) mounted around the piston rod (7) on the part thereof that lies between the damper (6) and the rocker (9).

10. The device according to claim 9, wherein the coil spring (11) is a pressure spring.

11. A device for securing a soft ending of the opening movement of a drawer as the drawer is drawn towards an outer limit stop, the drawer being mounted in a furniture body, comprising:

at least one rail between the drawer and the furniture body;

a damper filled with a fluid medium, wherein the fluid medium is one of gas, oil or water, wherein the damper is connected to at least one of the furniture body and a rail of the furniture body;

a piston with a piston rod being reciprocable in the damper, wherein a free end of the piston rod is connected to a tiltable rocker, the tiltable rocker being attached to the free end of the piston rod, wherein the rocker, whenever the piston rod is moved in and out in the damper, can be moved on a guide portion mounted at the damper, between a first end position close to the damper, and in which a first stud mounted at a back of the drawer may engage with the rocker, and a second end position far from the damper, and in which the piston rod is in its outermost position, such that the first stud may tilt the rocker when the drawer is approaching its fully opened position, and wherein the first stud is adapted to tilt the rocker and pull the free end of the piston rod in a direction away from the damper causing a dampening effect on the drawer and towards the second end position such that the piston rod is in its outermost position and the tilting of the rocker is arrested.

12. The device according to claim 11, further including a coil spring mounted around the piston rod on the part thereof that lies between the damper and the rocker.

* * * * *